United States Patent [19]

Härtel

[11] 4,359,433

[45] Nov. 16, 1982

[54] CONSTANT-PRESSURE CARBURETOR

[75] Inventor: Günter Härtel, Neuss, Fed. Rep. of Germany

[73] Assignee: Bosch & Pierburg System oHG, Neuss, Fed. Rep. of Germany

[21] Appl. No.: 166,826

[22] Filed: Jul. 8, 1980

[30] Foreign Application Priority Data

Jul. 28, 1979 [DE] Fed. Rep. of Germany ..... 2930737

[51] Int. Cl.[3] ..... F02M 15/04

[52] U.S. Cl. ..... 261/142; 123/549; 261/26; 261/30; 261/145; 261/50 A; 261/DIG. 82; 261/DIG. 81

[58] Field of Search .... 261/DIG. 82, 50 A, DIG. 81, 261/30, 26, 142, 145; 123/549

[56] References Cited

U.S. PATENT DOCUMENTS

| | | | |
|---|---|---|---|
| 1,150,115 | 8/1915 | Heinze, Jr. | 123/549 |
| 1,278,880 | 9/1918 | De Orlow | 123/549 |
| 1,325,998 | 12/1919 | Schmid et al. | 123/549 |
| 2,134,877 | 11/1938 | Jedrzykowski | 261/DIG. 81 |
| 3,054,603 | 9/1962 | Rodgers | 261/50 A |
| 3,198,498 | 8/1965 | Mennesson | 261/50 A |
| 3,236,506 | 2/1966 | Mennesson | 261/50 A |
| 3,281,131 | 10/1966 | Mennesson | 261/50 A |
| 3,406,952 | 10/1968 | White | 261/50 A |
| 3,738,622 | 6/1973 | Tuckey | 261/DIG. 68 |
| 3,930,477 | 1/1976 | Jordan | 123/549 |
| 3,957,929 | 5/1976 | Gural et al. | 261/50 A |
| 3,967,608 | 7/1976 | Mennesson | 261/50 A |
| 4,089,308 | 5/1978 | Pierlot | 261/50 A |
| 4,206,735 | 6/1980 | Miles et al. | 261/50 A |

FOREIGN PATENT DOCUMENTS

| | | | |
|---|---|---|---|
| 1776239 | 8/1974 | Fed. Rep. of Germany . | |
| 1207228 | 9/1970 | United Kingdom | 261/50 A |
| 2028431 | 5/1980 | United Kingdom | 261/DIG. 82 |

*Primary Examiner*—Tim R. Miles

*Attorney, Agent, or Firm*—Toren, McGeady & Stanger

[57] ABSTRACT

In a constant-pressure carburetor having a fuel/air mixing chamber (3) which operates under reduced pressure, fuel feed means through which the fuel is drawn into the mixing chamber (3) from a float chamber (6) as required, an air inlet duct (1) having an automatically vacuum controlled air intake valve (2) upstream of the mixing chamber (3), and a suction duct having a driver actuated throttle member (4) downstream of the mixing chamber (3), the fuel feed means includes a fuel atomizer nozzle (5) having a central fuel supply passage (14) surrounded concentrically at its outer end by an annular constricting atomizing air outlet (15) whereby the velocity vectors of fuel and atomizing air at the nozzle outlet differ in magnitude and direction, and proportioning means for regulating the flow of fuel through the central passage (14) of the nozzle (5) and including a member (11) which is movable towards and away from the inlet (10) to the passage (14) by a control (12) operated in response to the output (A) from an electronic control unit (13) having one or more operating parameter impuls ($E_1$ to $E_N$). Atomizing air is supplied to the outlet (15) of the nozzle (5) by a passage (16) communicating with the air inlet duct (1). Alternatively the passage (16) may communicate with an air compressor. The mixing chamber wall is heated and the fuel atomizer nozzle (5) leads from the mixing chamber wall obliquely into said mixing chamber.

30 Claims, 5 Drawing Figures

CONSTANT-PRESSURE CARBURETOR

This invention relates to constant-pressure carburettors having a fuel/air mixing chamber which operates under reduced pressure, fuel feed means through which fuel is drawn into the mixing chamber from a float chamber as required, an air inlet duct having a vacuum-controlled air intake valve upstream of the mixing chamber, and a suction duct having a driver-actuated throttle member downstream of the mixing chamber.

In known constant-pressure carburettors of this kind, the air intake valve mechanically controls the fuel feed means to proportion the supply of fuel according to the air flow, for example by means of a needle valve which controls the free cross-sectional area of a passage through which the fuel is drawn into the mixing chamber by the reduced pressure in the chamber. A fuel-air emulsion then forms in the mixing chamber. It is further known not to allow such an emulsion to be formed in the mixing chamber but instead to draw an already formed emulsion into the mixing chamber. It has been found that such constant-pressure carburettors suffer from various problems, particularly when the engine is cold, which lead to undesirable effects, such as harmful substances in the exhaust gases and excessive fuel consumption. One problem is that the fuel-air emulsion in the mixing chamber leads to unwanted fuel deposits on the chamber wall, and another is that purely mechanical control of the fuel proportioning is not particularly well suited to meet all the engine operating conditions in a completely satisfactory manner.

It is therefore an object of the invention to improve constant-pressure carburettors of the kind described in a comparatively simple manner so that the engine will operate with little production of harmful substances and low fuel consumption even in critical operational phases, and there is greater versatility in adjusting the fuel proportioning to suit the various operating requirements of the engine.

According to the invention a constant-pressure carburettor of the kind described is characterised in that the fuel feed means comprises a fuel atomizer nozzle of high atomizing quality which opens into the mixing chamber between the air intake valve and the throttle member, and which has a central fuel supply passage surrounded concentrically at its outlet end by an annular atomizing air outlet whereby the velocity vectors of fuel and atomizing air at the nozzle outlet differ in magnitude and direction, and proportioning means for regulating the flow of fuel through the central fuel supply passage of the nozzle, the proportioning means comprising an electronically controlled valve, and the atomizing air outlet of the nozzle communicating with a passage for supplying atomizing air to the nozzle. Electronically controlled fuel proportioning can be carried out considerably more easily and in a more versatile manner compared with solely mechanically controlled fuel proportioning, and is easily adapted to different operating conditions. With electronically controlled fuel proportioning, apart from determining the amount of fuel supplied to the mixing chamber according to the air throughput (by taking into consideration the particular position of the air intake valve), the accuracy of the proportioning can be improved by taking into consideration further operating parameters, such as the differential pressure at the air valve, and the absolute pressure and temperature at the carburettor inlet. Electronic control of the fuel proportioning further renders possible suitable control in critical operating phases, such as when the engine is cold, which reduces the production of harmful substances and fuel consumption.

At the same time, the high degree of fuel atomization in the mixing chamber leads to such a fine and large-area distribution of fuel mist that the disadvantages occurring with emulsions in known constant-pressure carburettors are largely avoided, particularly in conjunction with the electronic control of the fuel proportioning. Altogether the invention renders possible a better fuel-air mixture preparation in the mixing chamber, a more favourable distribution of the mixture to the individual cylinders, and a satisfactory uniformity in time of the mixture composition, and can do so by simple control at a single proportioning position for the whole operating range. The satisfactory mixture preparation permits the combustion of very much weaker mixtures and improves the intermittent operation with reduced demands on the suction line. With a constant-pressure carburettor in accordance with the invention, not only present-day regulations, but also considerably stricter exhaust-gas and fuel consumption regulations can be met in a satisfactory manner.

Preferably the fuel atomizer nozzle used is one in which the annular atomizing air outlet of the nozzle constricts and throttles the atomizing air which is supplied to it by the atomizing air supply passage. Such an atomizer nozzle, which is known in fuel injection systems such as that described in German Specification DE-AS No. 1 776 239, Aug. 22, 1974 leads to a considerably improved mixture preparation in constant-pressure carburettors, and to more favourable operating conditions in conjunction with electronically controlled fuel proportioning.

The fuel atomizer nozzle preferably leads into the mixing chamber obliquely from the wall of the chamber. Vaporization of the atomized fuel impinging on the wall may then be effected, when appropriate, by electrical heating means or by the engine coolant or exhaust gases in the mixing chamber wall downstream of the air intake valve to beyond the throttle member. This measure has the advantage, above all when the engine is cold, of avoiding precipitation of the fuel on the mixing chamber wall and achieving an even more favourable mixture preparation. The vaporization of the fuel can be effected quickly and with little energy because of the high degree of atomization and the associated fineness of the fuel particles resulting from the atomizer nozzle. Particularly favourable results are obtained if the wall of the mixing chamber contains an annular chamber surrounding the electrical heating means and adapted to thermally insulate the wall when it is electrically heated and to heat the mixing chamber wall in place of the electrical heating means when the engine is hot by conveying the engine coolant or exhaust gases. In this case, when the engine is cold, that is to say its cooling water is cold, the mixing chamber wall is heated electrically, for example by means of PTC elements, and the annular chamber is empty. When the engine is hot, however, the electrical heating means is switched off and the sufficiently hot cooling water is introduced into the annular chamber as a heating medium. This provides heating of the mixing chamber wall with optimum use of available energy and without problems, since the single fuel atomizer nozzle is situated further upstream.

In one embodiment of the invention, the fuel proportioning means includes a fuel throttle valve disposed in the central fuel supply passage between the electronically controlled valve and the nozzle outlet, the fuel throttle valve being controlled mechanically by the air intake valve. In this case, the main fuel proportioning is effected by the variable fuel throttle valve according to the air throughput as determined by the air intake valve, and the operation of the electronically controlled valve is restricted to correcting and shut-off controls of the fuel proportioning. In other words the two mechanically and electronically controlled valves can be operated simultaneously to continuously control the fuel proportioning according to different parameters.

A particularly simple construction results if the air intake valve and/or the throttle valve are constructed in the form of flap valves. This is possible without presenting problems since the fuel proportioning means of carburettors in accordance with the present invention do not comprise a mechanically controlled needle valve as is usual in conventional constant-pressure carburettors.

Preferably the air intake valve is adjusted mechanically by a pneumatic controller depending on operation. Although an electrical controller may be possible, the pneumatic-mechanical form is particularly suitable because the air intake valve adjustments are in any case dependent on the pressures in the carburettor. A practical form of the controller comprises a housing containing a vacuum chamber and a control chamber separated by a diaphragm, the vacuum chamber communicating with the mixing chamber and containing a compression spring which acts on the diaphragm, and an actuating rod connecting the diaphragm to the air intake valve to operate the valve in response to movement of the diaphragm. The control chamber may be connected to the carburettor air inlet duct, and in this case the air intake valve is always adjusted so that substantially the same vacuum is established in the mixing chamber regardless of the particular air throughput. Instead of this, however, the control chamber may be connected either to the carburettor air inlet duct or to an air compressor as determined by a control device according to the operation of the engine. In this case the air-valve controller can be overridden for certain operating conditions. This is important, for example, if the compression spring in the vacuum chamber of the air-valve controller is designed to be relatively hard so as to produce a greater vacuum in the mixing chamber and thereby provide a pressure difference sufficient for a high degree of fuel atomization in performance ranges with high suction line vacuums. In this case, when greater throughputs of air are necessary on quickly opening the throttle member or under full load, in order to avoid too great a throttling of the suction air at the air intake valve, the normal operation of the air valve controller is overridden by the connection to it of the air compressor so as to further open the air valve. The resulting reduction in the pressure difference necessary for a high quality fuel atomization may be compensated, for full-load operation, by measures which will be explained below, in order to ensure that the quality of the fuel atomization always remains constant.

In a simple embodiment of the invention the atomizing air supply passage opens into the carburettor air inlet duct upstream from the air intake valve. However, if the compression spring present in the vacuum chamber of the air valve controller is relatively soft, so as not to cause excessive throttling of the suction air even under full load, a relatively limited pressure difference results for the atomizing air between the carburettor inlet and the outlet of the atomizer nozzle. In this case more favourable pressure conditions may be obtained if the atomizing air supply passage is connected to an air compressor. If this is constantly in operation, the compression spring in the air valve controller can be designed to be relatively soft and an adequate pressure difference for a high degree of fuel atomization is always ensured.

Even better operation can be achieved, however, if the atomizing air supply passage is connected either to the carburettor air inlet duct or to an air compressor depending on engine operation. In the case where the control chamber of the air valve controller is connected to the air inlet duct or to an air compressor under the control of a control device sensitive to the engine operation, it will be convenient to connect the atomizing air supply passage and the control chamber. With such arrangements it is particularly appropriate to provide a pressure equalising aperture between a fuel float chamber and the atomizing air supply passage. In these cases, the compression spring in the vacuum chamber of the air valve controller can be designed hard, which makes operation of the air compressor superfluous when the engine is operating with high suction line vacuum. Only with greater throughputs of air or under full load is the air valve controller overridden in the manner described earlier, and the resulting reduction in the pressure difference available for the fuel atomization is overcome by operation of the air compressor to supply the atomizing air. As a result of the pressure equalising connection between the atomizing air supply passage and the fuel float chamber, there is always an adequate pressure difference across the float chamber to ensure effective proportioning of the fuel. Such embodiments in which operation of an air compressor is controlled by a control device according to the air throughput of the carburettor to override the air valve controller and to compensate for the reduced pressure drop across the air valve at high air throughput rates has proved particularly efficient and energy-saving.

The control device may comprise a diaphragm separating first and second diaphragm chambers, the first chamber having an inlet which is connected to the outlet of the compressor and which is provided with a valve spring-loaded towards closing the inlet, and an outlet from the first diaphragm chamber, the second diaphragm chamber having a control inlet in communication with the carburettor section downstream of the throttle member, a compression spring disposed so as to urge the diaphragm towards a position in which it engages and opens the inlet valve of the first chamber, and means for controlling operation of the air compressor according to the position of the diaphragm. Preferably the compressor control means comprises an electric switch for making and breaking a current supply to the air compressor, the switch closing to operate the compressor when the vacuum in the second diaphragm chamber falls sufficiently.

In one embodiment, a throttle control connection may be provided between the mixing chamber and the first diaphragm chamber of the control device so that the device is responsive effectively to the pressure drop across the throttle member. This arrangement ensures that only when the throttle member is opened sufficiently wide is the air compressor set in operation to override the air valve controller and to provide the atomizing air supply.

The control device may be constructed differently, if desired, for example in the form of an electric control valve with corresponding pressure sensors. The pneumatic construction described in the present case is, however, simpler from the structural point of view.

For the purpose of controlling the air flows in embodiments provided with a pneumatic control device as described above, preferably the carburettor air inlet duct, the outlet from the first diaphragm chamber of the control device, and the control chamber of the air intake valve controller are respectively connected to first, second, and third ports of a non-return valve having a shut-off member which closes the first port when the inlet valve of the first diaphragm chamber of the control device is open and the air compressor is operating. In this case, if a throttled control connection is present between the mixing chamber and the first diaphragm chamber of the control device, the shut-off member preferably closes the second port of the non-return valve when the inlet valve of the first diaphragm chamber is closed. On the other hand, if there is no connection between the mixing chamber and the first diaphragm chamber of the control device, it is preferred that the shut-off member should release or not close the second port of the non-return valve when the inlet valve of the first diaphragm chamber is closed.

Such non-return valves are simple in construction and economical, and render an effective valve control for the operating states of the carburettor both with and without the air compressor in operation. The non-return valve is always actuated so that the appropriate pressures are communicated to the air valve controller and the atomizing air supply passage, i.e. from the air inlet duct when the air compressor is switched off, and from the air compressor when it is switched on as a result of high air throughput or a quickly opened throttle member.

The electronically controlled valve of the fuel proportioning means preferably comprises a member which is movable towards and away from the inlet of the central fuel supply passage of the atomizing nozzle by a valve control operated in response to the output from an electronic control unit having one or more operating parameter inputs. This control unit may, for example, be constructed substantially in the form of a microprocessor and itself may effect a rapid and efficient function control of the fuel proportioning in a continuous and/or timed manner depending on various operating parameters and stored performance conditions.

In another energy-saving embodiment utilising an air compressor, the compressor may be pneumatically driven, comprising a plunger pump driven by pressure fluctuations in the suction line of the carburettor, and non-return valves at the pump inlet and outlet. In this case, no separate electrical energy supply for the air compressor is necessary, and only the energy of pressure fluctuations, which is available in any case, is utilized in a particularly effective manner to carry out the overriding and pressure-drop compensation operations necessary upon increased air throughput.

Various examples of the constant pressure carburettor in accordance with the invention will now be described with reference to the accompanying drawings, in which.

Figure 1:
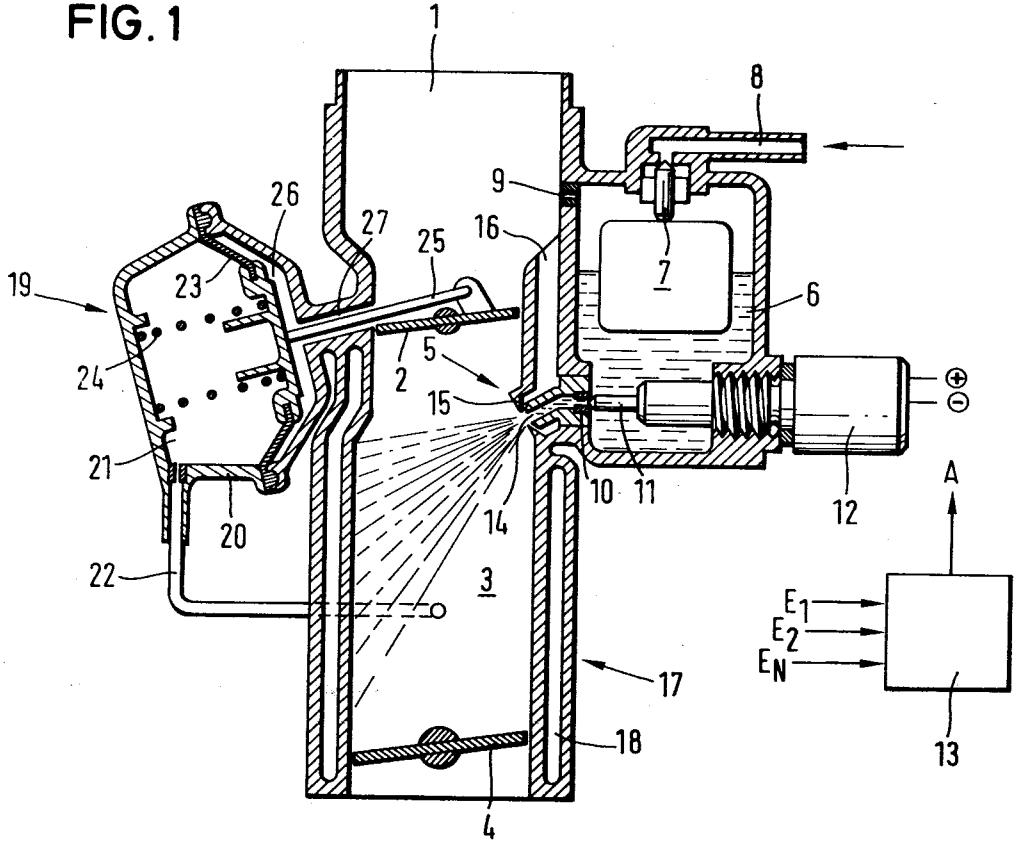
FIG. 1 is a diagrammatic, part sectional, view of a first example.

In the different Figures, corresponding parts are provided with the same reference numerals. In each case a constant-pressure carburettor is shown having a carburettor air inlet duct 1 provided with an adjustable air valve 2, shown as a flap valve, at its downstream end. Downstream of the air valve 2 is a mixing chamber 3 having at its downstream end a throttle member 4, also shown as a flap valve, which in use is operated by the driver through a linkage which is not shown. When the carburettor is fitted in an engine, the passage downstream from the throttle member 4 communicates with an engine suction line leading to one or more of the cylinders.

Near the air valve 2 there is a fuel atomizer nozzle 5 directed obliquely from the wall into the mixing chamber 3. Fuel is supplied to this atomizer nozzle 5 from a float chamber 6 which comprises a float 7 and is supplied with fuel through a fuel line 8. Above the level at which fuel is maintained in the float chamber 6, the chamber has an aperture 9 for the purpose of pressure equalization. In the examples shown in FIGS. 1, 2 and 3 the aperture 9 leads from the chamber 6 into the carburettor inlet duct 1, but in the examples shown in FIGS. 4 and 5, it leads, for reasons which will be explained later, from the chamber 6 into a passage 16 for the supply of atomizing air to the fuel atomizer nozzle 5. Fuel flows to the atomizer nozzle 5 from the float chamber 6 through a passage 14, and in each example except that shown in FIG. 2, the inlet to the passage 14 at the lower end of the chamber 6 is provided with a flow control valve formed by a nozzle 10 and a movable throttle member 11 in the form of a shank having a tapered point which is operationally associated with the nozzle 10. The throttle member 11 is operated by an electrical valve control 12 which may work continuously or intermittently and is controlled through its positive and negative terminals by the output A from an electronic control unit 13. The control unit 13 has a plurality of inputs $E_1$, $E_2$, $E_N$ by which various different operating parameters can be taken into consideration in determining the correct fuel flow. One of the main parameters which is normally taken into account, although not in the example of FIG. 2, is the air throughput, that is to say the position of the air valve 2. Further operating parameters, such as the differential pressure at the air valve 2 and the absolute pressure and the temperature at the carburettor inlet, can be likewise taken into consideration by the control unit 13 to increase the accuracy of the fuel control. In all examples, the control unit 13 may also process further input information, such as the engine speed, the suction-line pressure, the opening angle and the opening speed of the throttle member 4, the composition of the engine exhaust gas, and irregular running of the engine.

The fuel atomizer nozzle 5 has a constricted annular atomizing air outlet 15 which concentrically surrounds the central fuel supply passage 14 and is connected to an air supply passage 16. In the examples shown in FIGS. 1 and 2, the passage 16 leads from the carburettor inlet duct 1, whereas in the example of FIG. 3 the passage 16 leads from an air compressor 31, and in the examples shown in FIGS. 4 and 5 it leads from a non-return valve 50 or 58. The atomizing air outlet 15 throttles the air supplied through the passage 16, thereby increasing its speed, and directs the atomizing air stream to ensure a high degree of fuel atomization of the proportioned fuel drawn obliquely into the mixing chamber 3.

All of the examples have heating means 17 in the region of the mixing chamber wall downstream of the fuel atomizer nozzle 5. The heating means 17 comprises an annular chamber 18 which surrounds the mixing chamber 3 and through which the water of the engine cooling system is arranged to flow when the engine is hot. When the engine is cold the chamber 18 remains empty so as to effect thermal insulation to electrical heating of the wall between the annular chamber 18 and the mixing chamber 3, preferably with PTC elements. Note the electrical heater 17A in FIG. 3 with the connections a and b. The heating means 17 ensures that the very finely atomized fuel mist impinging on the wall of the mixing chamber 3 can be vaporized rapidly, thereby saving energy and achieving a further improvement in the mixture preparation.

All examples further have an air-valve controller 19 comprising a housing 20 containing a diaphragm 23. A vacuum chamber 21 on one side of the diaphragm 23 is in throttled communication with the mixing chamber 3 through a pipe 22, and contains a compression spring 24 which presses against the diaphragm 23. The diaphragm 23 is connected by an actuating rod 25 to the air valve 2 so that the valve 2 moves in response to movements of the diaphragm. On the side of the diaphragm 23 opposite to the vacuum chamber 21 the housing contains a control chamber 26 which, in the examples of FIGS. 1 to 3, communicates freely with the carburettor inlet duct 1 through a passage 27 through which the actuating rod 25 extends. In the examples shown in FIGS. 4 and 5 this passage 27 is sealed around the rod 25 by means of a bush 35.

In the example shown in FIG. 2 there is a direct mechanical control connection 28 between the air valve 2 and an adjustable throttle valve 29 in the fuel passage 14 leading from the float chamber 6 to the atomizing nozzle 5. The control connection 28 is preferably constructed so that an approximate proportional relationship is obtained between the air throughput and the amount of fuel fed in. In this case, the operation of the valve control 12 and of the throttle member 11 can be restricted to functioning as correction and shut-off means for the fuel proportioning. For this reason, the fuel inlet nozzle 10 present in the other examples is not necessary in that of FIG. 2 since the main fuel proportioning is effected by the throttle valve 29. If desired, however, two fuel proportioning operations carried out in series and depending on different operating parameters may be performed.

Figure 3:
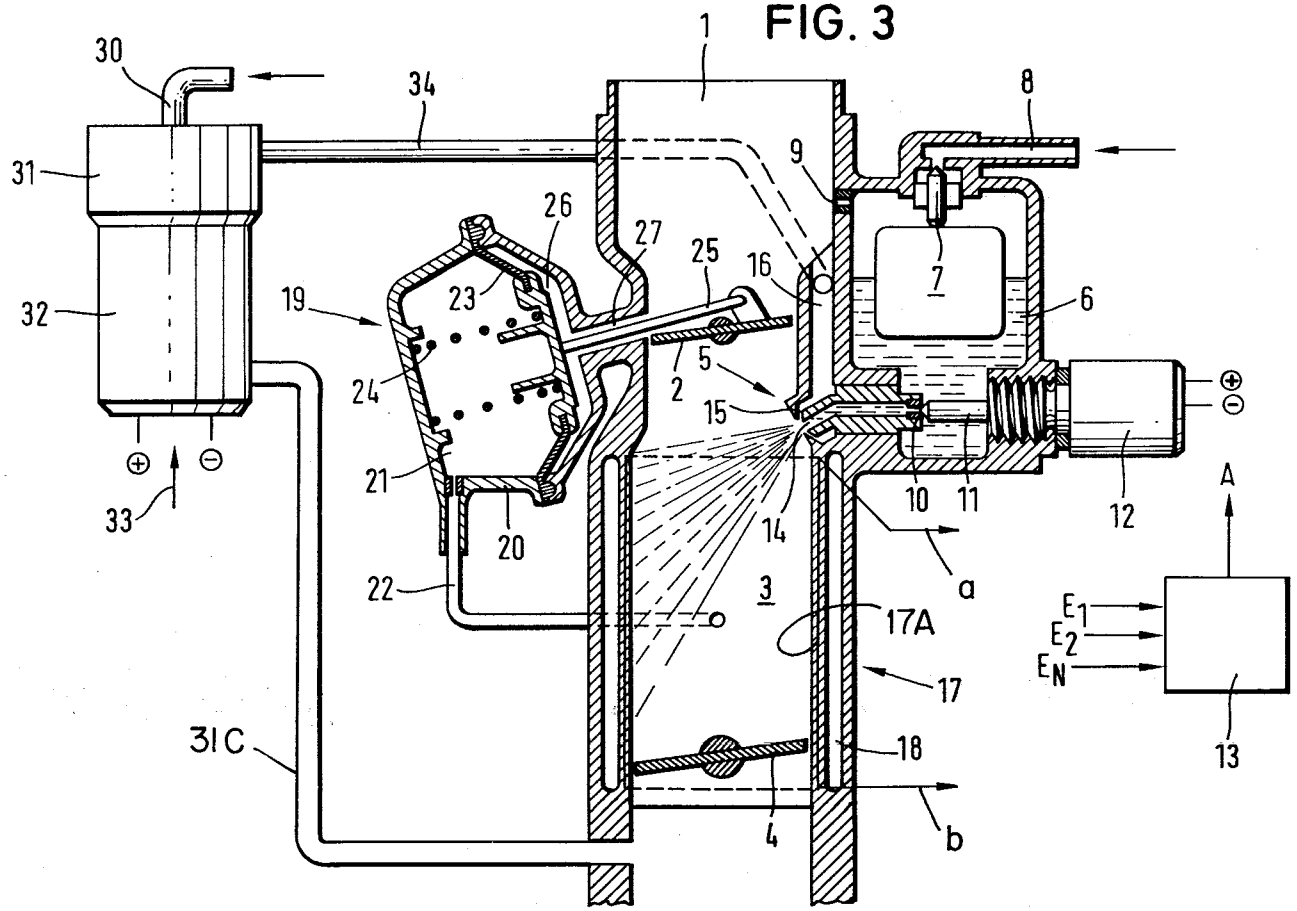
FIG. 3 is a similar view of a third example.
Figure 4:
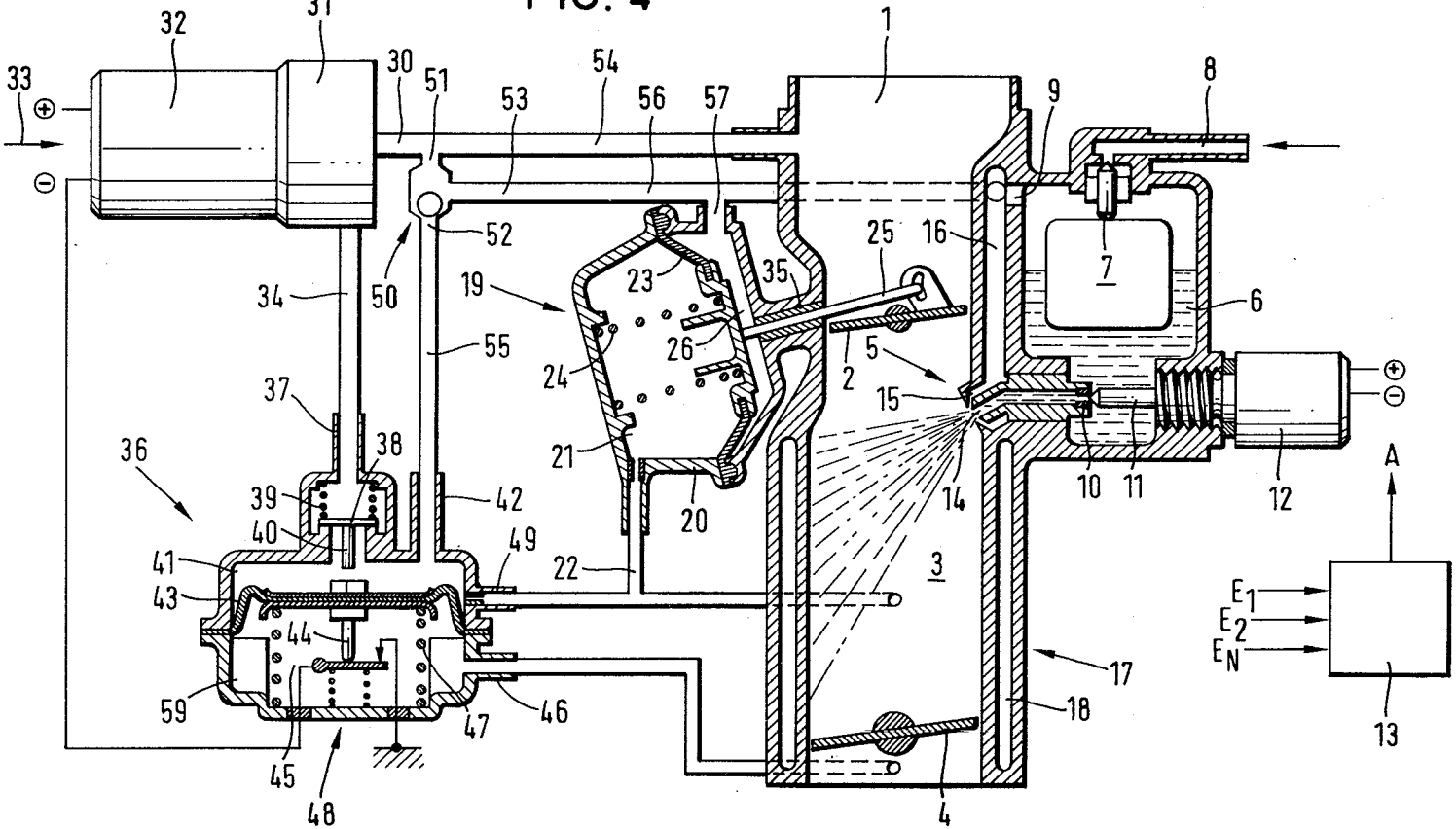
FIG. 4 is a similar view of a fourth example.
Figure 5:
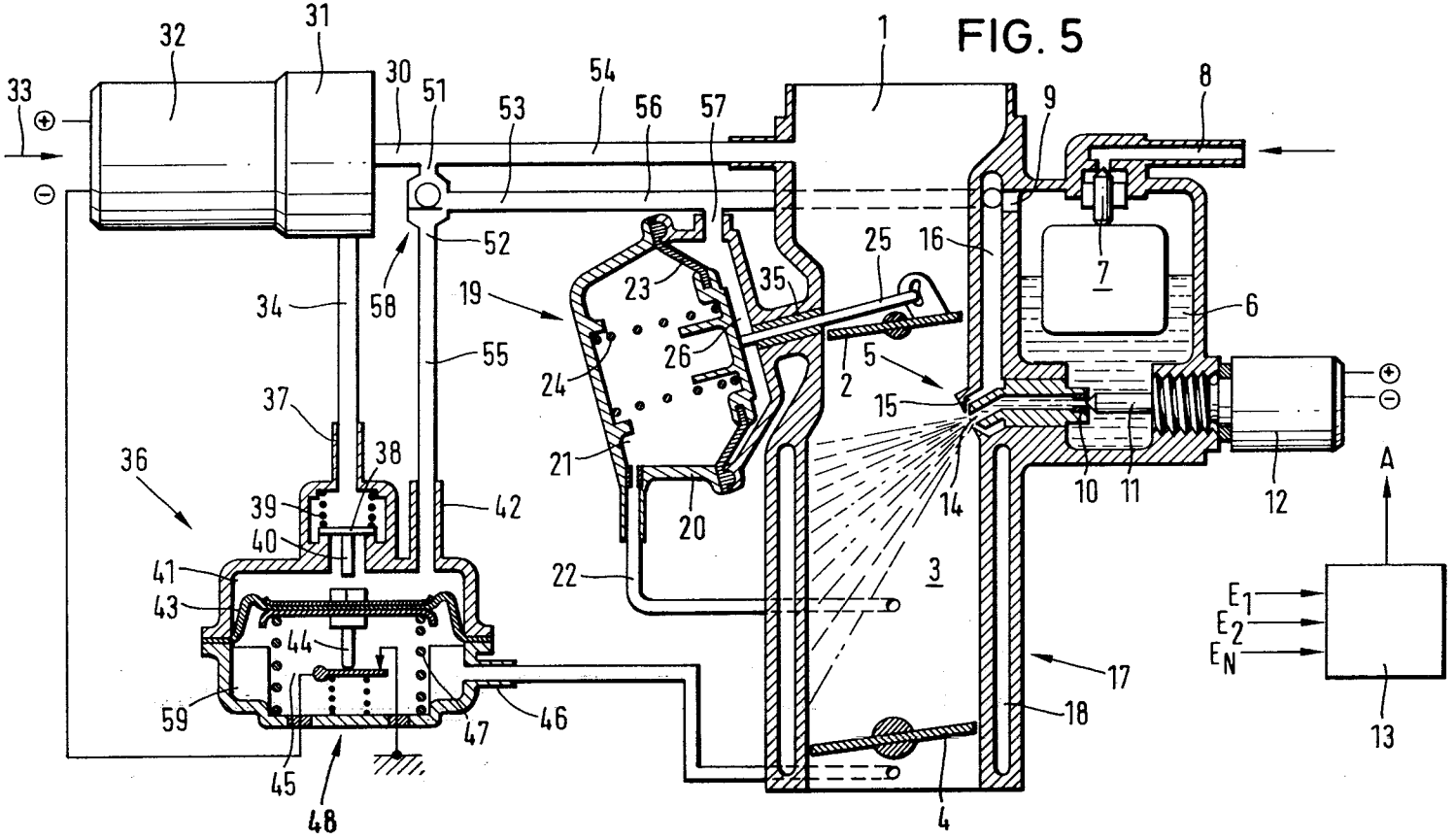
FIG. 5 is a similar view of a fifth example.

In the examples of FIGS. 3 to 5, the carburettor is provided with an air compressor 31 having an inlet 30, a compressor drive 32 driven electrically through input terminals 33, and an outlet 34. Air drawn in through the inlet 30 is pressurized and delivered as atomizing air at the outlet 34. In the example of FIG. 3 this is conveyed directly to the passage 16, but in the examples of FIGS. 4 and 5 is supplied to a control device 36. Further in FIG. 3, the air compressor 31 is connected by a duct 31*a* to the suction duct of the carburettor.

The control device 36 in the fourth and fifth examples has an inlet 37 connected to the outlet 34 of the compressor 31 and containing a valve 38 which is prestressed in the valve closing direction by a compression spring 39 and which comprises a stem 40 projecting somewhat into a first diaphragm chamber 41 adjacent the valve 38. This chamber 41 has an outlet 42 and is bounded by a diaphragm 43. On the side of the diaphragm 43 opposite to the chamber 41, a push rod 44 connected to the diaphragm projects into a second diaphragm chamber 45 which communicates through a pipe 46 with the carburettor section downstream of the throttle member 4. In the second diaphragm chamber 45 there is a compression spring 47 which acts on the diaphragm 43, and there is also an electrical switch 48 which, upon appropriate opening action of the push rod 44, interrupts an earth line leading to the negative terminal of the electrical input 33 to the compressor drive 32. The opening of the electrical switch 48 is effected whenever there is sufficient vacuum in the second diaphragm chamber 45 to displace the diaphragm 43 against the stress of the compression spring 47. On the other hand, when the diaphragm 43 moves towards the valve 38 in response to pressure increase in the second diaphragm chamber 45, the electric switch 48 is closed and the compressor drive 32 is actuated because the positive terminal of its electrical input 33 is live whenever the ignition is switched on.

In the example shown in FIG. 4, the first diaphragm chamber 41 of the control device 36 comprises a throttled control inlet 49 connected to the pipe 22 leading from the air valve controller 19 to the mixing chamber 3. The outlet 42 of the first diaphragm chamber 41 is connected by a pipe 55 to a double-acting non-return valve 50 having a first connection 51 connected to a pipe 54 leading from the carburettor inlet duct 1 to the compressor inlet 30, a second connection 52 which is connected to the pipe 55, and a third connection 53 which is connected to a pipe 56 leading to the passage 16 and also communicating through a branch 57 with the control chamber 26 of the air valve controller 19. The non-return valve 50 has a spherical shut-off member, not designated, which can close the first and second connections 51, 52 alternately according to the pressure conditions prevailing.

In the example shown in FIG. 5 there is no direct flow connection between the first diaphragm chamber 41 of the control device 36 and the mixing chamber 3. The outlet 42 of the first diaphragm chamber 41 is connected by a pipe 55 to a non-return valve 58 having a first connection 51 connected to a pipe 54 leading from the carburettor inlet duct 1 to the compressor inlet 30, a second connection 52 which is connected to the pipe 55, and a third connection 53 which is connected to a pipe 56 leading to the passage 16 and also communicating through a branch 57 with the control chamber 26 of the air valve controller 19. The non-return valve 58 has a spherical shut-off member, not designated, which can on the one hand seal off the first connection 51 and on the other hand be brought to bear against a central stop, also not designated, to open all the connections 51, 52 and 53, according to the pressure conditions prevailing.

The control device 36 represents a combination of a pressure switch and a pressure regulator. As a result of this combination, the technical expenditure is reduced and the accuracy of the working points (switch position and pressure regulating position of the diaphragm 43) is increased as a result of the fact that only one compression spring 47 and one diaphragm 43 are used in slightly different stroke positions.

A description of the operation of the different constant-pressure carburettors illustrated now follows in the order of FIGS. 1 to 5. It should be noted, however, that the constant-pressure carburettors described are only explained in detail with regard to their functional differences from previous constant-pressure carburettors.

Figure 2:
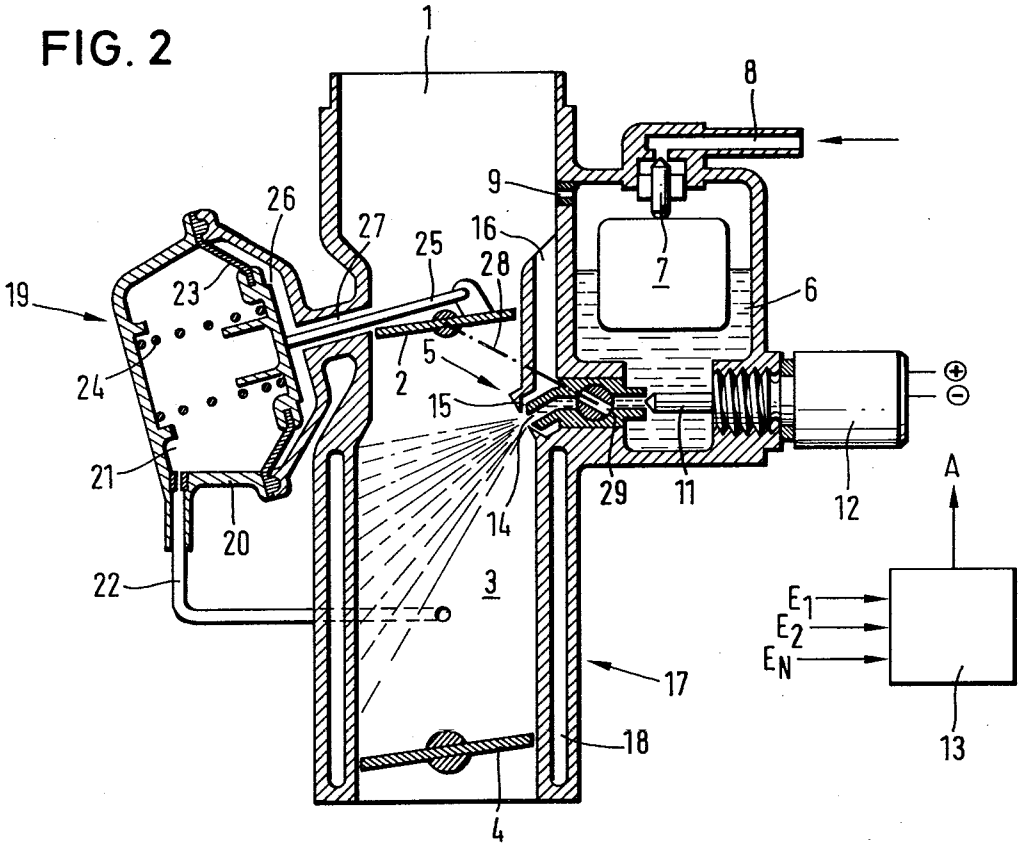
FIG. 2 is a similar view of a second example.

In the example of FIG. 1 the amount of fuel/air mixture drawn in by the combustion engine through the suction line (not illustrated) is determined according to the position of the throttle member 4. As a result of the flow, a reduced pressure develops in the mixing chamber 3 and is communicated to the vacuum chamber 21 of the air-valve controller 19 through the pipe 22.

The compression spring 24 urges the diaphragm 23 towards a position of rest in which the air valve 2 is closed by the actuating rod 25. The control chamber 26 is maintained in pressure equilibrium with the carburettor inlet duct 1 by virtue of the passage 27. In operation, the pressure in the vacuum chamber 21 falls until the force exerted by the pressure difference across the diaphragm 23 reaches a value which equals the force exerted by the compression spring 24. When the force resulting from the pressure difference increases further the diaphragm 23 will yield, against the force of the compression spring 24, until the throttle action of the air valve 2 is reduced to such an extent that an equilibrium of forces is again established at the diaphragm 23. With a predetermined force constant of the compression spring 24, the position of the air valve 2 is a measure of the air throughput of the carburettor.

The pressure difference established at the air valve 2 added to the pressure difference from the geodetic height of the fuel in the float chamber 6 related to the outlet point of the fuel from the atomizer nozzle 5 provides the conveying energy in the metering of the fuel to the mixing chamber 3 by the valve control 12. The fuel proportioning effected by means of the throttle member 11 and the nozzle 10 in response to the control 12 can be effected by varying the free cross-sectional area through the nozzle or, with timed operation, by varying the opening times of the nozzle 10. The electronic control unit 13 controlling the valve control 12 processes, apart from a number of other input parameters, information concerning the particular position of the air valve 2 (provided by an angle of rotation indicator on the shaft of the air valve 2 or a stroke indicator on the diaphragm 23, neither being illustrated). Thus a simple control of the amount of fuel fed in according to the air throughput is possible by means of the electronic control unit 13. In order to increase the accuracy, apart from the position of the air valve 2, the pressure difference appearing at the valve 2 as well as the absolute pressure and the temperature at the carburettor inlet may additionally be measured and supplied to the control unit 13 for processing.

In order to prepare the fuel metered to the nozzle 5, air is drawn from the carburettor inlet duct 1 through the passage 16, by-passing the air valve 2, to the atomizer nozzle 5. The metered fuel entering the chamber 3 from the passage 14 is atomized by the air stream entering the chamber 3 through the annular constriction 15 at the nozzle 5, and results in a very fine mist of fuel droplets. The portion of this mist which is not directly entrained by the intake air impinges on the wall of the mixing chamber 3. This wall is heated, for example by means of the exhaust gases, the engine cooling water as described and/or by PTC elements, so that the liquid particles of fuel quickly vaporize.

In connection with the second example shown in FIG. 2, it has already been explained that this differs from the first example substantially only in that the fuel supply is metered primarily by the adjustable valve 29 controlled by the connection 28 to the air valve 2, instead of by a needle valve at the float chamber end of the passage 14. To this extent, no basic operational differences result.

In the third example shown in FIG. 3, the air for the atomization of the fuel at the nozzle 5 is no longer taken off directly from the carburettor inlet duct 1 but is supplied by the air compressor 31 which runs constantly. The compressed air supplied to the passage 16 means that an adequate pressure for the fuel atomization by the atomizer nozzle 5 is always ensured, without the pressure drop at the air valve 2 having to be increased by using an appropriately hard compression spring 24. Increasing the hardness of the compression spring 24 has the disadvantage that an increased throttling of the indrawn air at the air valve 2 is effected under full load. This can lead to an inadequate air throughput and a reduced filling of the cylinders for the required operation. This disadvantage is avoided by means of the constantly compressed atomizing air provided in the example of FIG. 3, since the compression spring 24 may be made relatively soft.

In the fourth and fifth examples shown in FIGS. 4 and 5, the compressor drive is controlled by means of the control device 36 so that the compressor 31 operates to supply the atomizing air only when the engine is operating such that no adequate pressure difference is made available for the atomization of the fuel at the atomizer nozzle 5. When the engine is operating with high suction-line vacuums, the pressure in the mixing chamber 3 is lowered, by suitable design of the compression spring 24, to such an extent that, in comparison with the pressure in the carburettor inlet duct 1, adequate pressure energy is available for the atomization of the fuel at the nozzle 5. In this case, the atomizing air is drawn from the carburettor inlet duct 1 through the pipe 54, the double-acting non-return valve 50 (FIG. 4) or the non-return valve 58 (FIG. 5), and the pipe 56, into the passage 16. Ventilation of the control chamber 26 is effected through the branch 57 of the line 56, and at the same time, the atomizing air in the passage 16 communicates through the aperture 9 serving to equalise the pressure in the float chamber 6.

In the example of FIG. 4, the mixing chamber pressure is additionally conveyed through the throttled control inlet 49 to the first diaphragm chamber 41 of the control device 36. With low pressure differentials across the diaphragm 43, the diaphragm is deflected by the force of the compression spring 47 and is brought into engagement with the stem 40 of the valve 38, as a result of which the valve 38 opens against the force of the compression spring 39. On such deflection of the diaphragm 43, the electric switch 48 is closed by means of a compression spring, not indicated, and the air compressor drive 32 is actuated. The compressed air generated by the air compressor 31 is delivered to the control device 36 and travels past the open valve 38 into the first diaphragm chamber 41 where the pressure rises accordingly. This rise in pressure is communicated through the pipe 55 and causes the shut-off member of the non-return valve 50 to move to the end position in which it closes the first connection 51. Thus the rise in pressure is further communicated to the control chamber 26 of the air-valve controller 19, the passage 16 for the atomizing air, as well as to the float chamber 6. Because of the throttle points at the atomizer nozzle 5 and at the control inlet 49, the rise in pressure increases in the first diaphragm chamber 41 until the force exerted by the pressure difference acting on the diaphragm 43 is in equilibrium with the force exerted by the compression spring 47. When the engine is in operation, the operation of the air compressor 31 depends on the pressure difference at the throttle member 4, which is reproduced as described in the first and second diaphragm chambers 41 and 45. In the event of differential pressures across the diaphragm which exceed the force of the compression spring 47, the diaphragm 43 is pressed against stops 59 in the second diaphragm chamber 45. Before the diaphragm reaches this position, the push rod 44 of the diaphragm 43 opens the electrical switch 48 to switch off the compressor drive 32, and the valve 38 is closed by the compression spring 39. If there is a drop below the pressure difference which is sufficient to press the diaphragm 43 against the stops 59 against the action of the compression spring 47, the switch 48 is first closed to set the air compressor 31 in operation. On a further drop in the pressure difference between the first and second diaphragm chambers 41, 45, the diaphragm 43 yields further under the action of the compression spring 47, and the valve 38 is opened to an extent such that the pressure rises in the first diaphragm chamber 41 until the differential pressure is sufficient to be in equilibrium with the force exerted by the compression spring 47. As the throttle member 4 opens increasingly further, the pressure below it rises and is transmitted to the second diaphragm chamber 45, as a result of which the pressure in the first diaphragm chamber 41 is increased by the same amount, as a counter force. The pressure in the control chamber 26 therefore also rises to the same extent via the pipes 55 and 56 and the branch 57. As a result, a deflection of the diaphragm 23 is effected against the force of the compression spring 24 and the air valve 2 is opened further, so that throttle losses are practically eliminated. The increased pressure in the passage 16 ensures an adequate atomization of the fuel supply, and since the increased pressure also acts on the float chamber 6 through the aperture 9, an adequate pressure difference further results for the supply of the fuel, even with substantially atmospheric pressure in the mixing chamber 3.

Accordingly, the fourth example (and also the fifth example) renders possible, on the one hand an adequate pressure difference for the atomization of the fuel at the atomizer nozzle 5 and for the proportioning of the fuel, by using a relatively hard compression spring 24, without, on the other hand, having to accept excessive throttling of the intake air at the air valve 2 under full load.

The reduction in the pressure drop at the air valve 2 with the throttle member 4 fully open can be effected as desired by the selection of the compression spring 47 in the control device 36. Preferably, however, the force of the compression spring 47 is selected so that the pressure difference across the diaphragm 43 when it is placed in the regulating position (that is to say in contact with the valve stem 40) is less than at the air valve 2. When the throttle member 4 is open fully or nearly fully, the pressure difference at the diaphragm is maintained as a result of the fact that the control device 36 works as a constant differential pressure regulator. The pressure appearing at the inlet 37 is only effective in the first diaphragm chamber 41 until an equilibrium of forces is established at the diaphragm 43.

Since the pressure difference at the throttle member 4 is absent under full load, an excess pressure automatically builds up in the diaphragm chamber 41 and balances the force of the compression spring 47. This excess pressure is communicated to the control chamber 26, as a result of which the pressure difference across the diaphragm 23 causes the diaphragm 23 to move against the force of the compression spring 24 until the pressure rise in the control chamber 26 has caused an equally great pressure rise in the vacuum chamber 21, because of the reduced pressure drop at the air valve 2. Since the force of the compression spring 47 is designed for a smaller pressure difference than the force of the compression spring 24, the air valve 2 remains closed to an extent such that a slight throttling of the intake air is still retained. On a variation in the air throughput (ratio 1:6 on a change of engine speed from 1000 to 6000 revolutions per minute), the position of the air valve 2 is automatically adapted to the particular air throughput. For this reason, a correlation between the position of the air valve 2 and the air throughput is obtained even in the full load range. This correlation is an advantage for the proportioning of the fuel. With excess pressure in the mixing chamber 3, the pressure rises through the passage 16 and the aperture 9 in the float chamber 6 by the same amount, as a result of which the pressure difference is retained at the fuel proportioning point, i.e. at the fuel nozzle 10.

It is worth observing that with increasing dethrottling at the air valve 2, as a result of the smaller pressure difference, larger cross-sectional areas of opening result for the particular air throughput, which correspond to a higher air throughput with a normal pressure difference at the air valve. If the proportional relationship between the position of the air valve 2 (free cross-section) and the air throughput is retained to determine the amount of fuel, without taking into consideration the pressure difference at the air valve 2 as a correction quantity, the intake mixture is enriched with increasing de-throttling at the air valve 2. This is desirable in an amount up to about 30%, because under partial load driving is effected with as weak a mixture as possible (about 20% air excess) and under full load with a rich mixture (about 10% air shortage) with a view to a full power yield. The enriching effect of 30% would be achieved with a free cross-section increased by 30% at the air valve 2, as a result of which a decrease in the throttle action of ($1.3^2=1.69$) about 70% would result. If this de-throttling is not sufficient in special cases, the introduction of the differential pressure as a correction quantity in the fuel proportioning would be necessary.

The fifth example shown in FIG. 5 is only slightly different from that shown in FIG. 4, in that the throttle control inlet 49 of FIG. 4 is absent and the double acting non-return valve 50 of FIG. 4 is replaced by the single acting non-return valve 58. The example shown in FIG. 5 requires dimensioning of the compression spring 47 for a higher differential pressure at the diaphragm 43 in comparison with the differential pressure at the diaphragm 23 required to overcome the force of the compression spring 24, to fulfil its function. When the pressure is communicated from the carburettor inlet duct 1 through the non-return valve 58 into the control chamber 26, the differential pressure at the diaphragm 23 corresponds to the differential pressure at the air valve 2.

When the throttle member 4 is fully open, the force of the spring 47 exceeds the force acting on the diaphragm 43 from the pressure difference, as a result of which the diaphragm 43 is moved to open the valve 38 until a pressure difference is established at the diaphragm 43 which leads to an equilibrium of forces with the compression spring 47. The increased pressure in the first diaphragm chamber 41 causes the shut-off member of the non-return valve 58 to close the first connection 51, and the pressure is then propagated further to the control chamber 26, to the passage 16, and to the float chamber 6. The increased pressure in the control chamber 26 leads to a rise in pressure in the mixing chamber 3 and in the vacuum chamber 21 until there is an equilibrium of forces acting on the diaphragm 23. When the throttle member 4 is fully open, the excess pressure exceeds the force of the compression spring 24 until the air valve 2 opens fully. On slight throttling of the stream of intake air at the throttle member 4, the pressure reduction downstream of the throttle member 4 is communicated to the second diaphragm chamber 45, and the excess pressure established in the first diaphragm chamber 41 for the equilibrium of forces acting on the diaphragm 43 falls by the same amount so that there is a gradual transition for the regulation of the excess pressure and hence the throttle action at the air valve 2.

In the example shown in FIG. 5, the correlation of the position of the air valve 2 with the air throughput is cancelled under full load. In this operating range, the fuel proportioning can be effected with sufficient accuracy according to the engine speed. At operating points very close to full load, that is to say in the range of small differential pressures at the air valve 2, these values may additionally be used as correction quantities for the fuel proportioning. As in the example shown in FIG. 4, the pressure difference at the fuel proportioning point is retained until the air valve 2 is fully open. On a further pressure increase, by appropriate selection of the compression spring 47, the required enriching effect can be achieved with the throttle member 4 fully open, in a simple manner, because the pressure difference at the fuel proportioning point increases while other parameters remain unaltered.

With the examples shown in FIGS. 1 and 2, a compromise must be reached between the atomizing pressure available and the air throughput, by selecting a compression spring 24 of medium hardness. In the example shown in FIG. 3, the compression spring 24 can be made soft, because the atomizing pressure is produced by the constantly running air compressor under all engine load conditions. In contrast, in the examples shown in FIGS. 4 and 5, it is possible to make the compression spring 24 soft and to operate the air compressor only in the full load range in order to achieve the necessary air throughput for filling the cylinders. For this purpose, the air valve controller 19 is overridden only under certain operating conditions, namely in the full load range, by excess pressure which is used at the same time in effecting the metering and atomization of the fuel supply.

As is illustrated in FIG. 1, merely by way of example only, a satisfactory thermal insulation may be achieved between the heated mixing chamber 3 and the float chamber 6 by a suitable material constriction in the mutual connection region. In addition, the fuel passage 14 is as short as possible and is constructed with a free flow from the float chamber 6, so as to avoid the formation of vapour bubbles at the proportioning point 10 as far as possible. Furthermore, as shown in FIG. 1, the diameter of the mixing chamber may be different in different sections of the mixing chamber, and in the example shown it is smaller in the region of the air valve 2 than in the remaining region. The selection of the diameter of the mixing chamber and the precise arrangement and position of the atomizer nozzle 5 should be chosen so that a largely equal distribution of the fuel droplets on the heated wall of the mixing chamber is achieved. These features may also be applied in the other examples.

The orientation of the mixing chamber 3 may be vertical as illustrated, but it may instead be horizontal, in which case the float chamber may be situated below, to the side of, or above the mixing chamber.

I claim:

1. In a constant-pressure carburettor for an engine comprising walls forming an axially extending fuel air/-mixture chamber which operates under reduced pressure, walls forming an axially extending air inlet duct upstream from and in general axial alignment with said mixing chamber, a vacuum controlled air intake valve between said air inlet duct and said mixing chamber, a suction duct downstream from said mixing chamber, a driver actuated throttle member between said mixing chamber and said suction duct, a float chamber, and fuel feed means through which fuel is drawn from said float chamber into said mixing chamber as required, the improvement wherein said fuel feed means comprises a fuel atomizer nozzle of high atomizing quality in one of said walls of said mixing chamber and opening obliquely into said mixing chamber with said nozzle located between and spaced from said air intake valve and said throttle member and directed in the downstream direction so that the fuel is directed obliquely across the axis of said mixing chamber toward the opposite surface thereof and in the downstream direction toward said throttle member, said atomizer nozzle having an axially extending central fuel supply passage with the axis of said passage at the outlet end thereof extending obliquely of the axis of said fuel air/mixing chamber and directed downwardly toward said throttle member and an annular atomizing air outlet concentrically surrounding the outlet end of said central fuel supply passage and constricting and throttling the supplied atomizing air whereby the velocity vectors of fuel and atomizing air at said outlets of said nozzle differ in magnitude and direction, proportioning means for regulating the flow through said central fuel supply passage, said proportioning means including an electronically controlled valve, and wall means in combination with said air inlet duct and said walls forming said mixing chamber forming a passage for supplying atomizing air to said atomizing air outlet of said nozzle, and heating means located in said walls of said mixing chamber downstream of said air intake valve and extending to said throttle member for heating the inner surface of said mixing chamber when the engine is cold and during normal operating conditions, said fuel atomizer nozzle is arranged to spray and atomize the fuel in the path of the air flow through said mixing chamber from said air inlet duct and any atomized fuel impinging on the heated surface of said mixing chamber is vaporized thereby avoiding precipitation of the fuel on the inner surface of said mixing chamber and affording a fine and large area distribution of the fuel mist within said mixing chamber.

2. A constant-pressure carburettor as claimed in claim 1, wherein said walls of said mixing chamber form an annular chamber extending downstream from adjacent said air intake valve to beyond said throttle member and adapted to heat said mixing chamber wall when the engine is hot by conveying the engine coolant or exhaust gases.

3. A constant-pressure carburettor as claimed in claim 1, wherein said air intake valve and said throttle member are flap valves.

4. A constant-pressure carburettor as claimed in claim 1, wherein said atomizing air supply passage leads directly from said carburettor air inlet duct.

5. A constant-pressure carburettor as claimed in claim 1, wherein said electronically controlled valve of said fuel proportioning means comprises a valve control, a member movable by said valve control towards and away from the inlet of said central fuel supply passage of said atomizing nozzle, and an electronic control unit providing an output which operates said valve control in response to one or more operating parameter inputs to said electronic control unit.

6. A constant-pressure carburettor as claimed in claim 1, wherein said central fuel supply passage of said atomizer nozzle is short in order to avoid the formation and accumulation of vapour bubbles in said passage.

7. A constant-pressure carburettor as claimed in claim 1, wherein said mixing chamber is disposed vertically.

8. A constant-pressure carburettor as claimed in claim 1, wherein said fuel proportioning means includes a fuel throttle valve disposed in said central fuel supply passage between said electronically controlled valve and said nozzle outlet, and mechanical control means connecting said fuel throttle valve to said air intake valve whereby said fuel throttle valve is controlled according to the position of said air intake valve.

9. A constant-pressure carburettor as claimed in claim 8, wherein said fuel throttle valve is operated by said air intake valve so that the amount of fuel supplied to said atomizer nozzle is in proportion to the air throughput.

10. A constant-pressure carburettor as claimed in claim 1, including an air compressor and means connecting said compressor to said atomizing air supply passage.

11. A constant-pressure carburettor as claimed in claim 10, wherein said air compressor is a pneumatically driven compressor adapted to be driven by pressure fluctuations in said suction duct of said carburettor.

12. A constant-pressure carburettor as claimed in claim 1, wherein the cross-sectional area of said mixing chamber varies between said air intake valve and said throttle member.

13. A constant-pressure carburettor as claimed in claim 12, wherein the position and orientation of said atomizing nozzle outlet, and the shape of said mixing chamber, are selected to achieve a substantially equal distribution of the atomized fuel droplets on said mixing chamber wall.

14. A constant-pressure carburettor as claimed in claim 1 wherein said heating means comprises electrical heating means.

15. A constant-pressure carburettor as claimed in claim 14, wherein said walls of said mixing chamber contains an annular chamber surrounding said electrical heating means and adapted to thermally insulate said walls when said walls are electrically heated and to heat said mixing chamber wall in place of said electrical heating means when the engine is hot by conveying the engine coolant or exhaust gases therethrough.

16. A constant-pressure carburettor as claimed in claim 14, including means which substantially insulates said float chamber thermally from said heated mixing chamber of said carburettor.

17. A constant-pressure carburettor as claimed in claim 16, wherein said float chamber is insulated from said mixing chamber by means of a constriction in said wall of said carburettor between said float chamber and the heated section of said wall.

18. A constant-pressure carburettor as claimed in claim 1, wherein said vacuum controlled air intake valve includes a pneumatic air intake valve controller and mechanical means operatively connecting said controller to said air intake valve.

19. A constant-pressure carburettor as claimed in claim 18, wherein said air intake valve controller comprises a housing defining a vacuum chamber and a control chamber, a diaphragm disposed in said housing and separating said vacuum chamber from said control chamber, a compression spring disposed in said vacuum chamber and acting on said diaphragm to bias said diaphragm towards said control chamber, and means communicating said vacuum chamber with said mixing chamber, said mechanical means connecting said controller to said air intake valve comprising an actuating rod connected to said diaphragm and said air intake valve whereby said valve operates in response to movement of said diaphragm.

20. A constant-pressure carburettor as claimed in claim 19, including means communicating said control chamber with said air inlet duct of said carburettor.

21. A constant-pressure carburettor as claimed in claim 19, including an air compressor and a control device responsive to engine load, and means for communicating said control chamber either with said carburettor air inlet duct or with said compressor as determined by said control device.

22. A constant-pressure carburettor as claimed in claim 21, including means for communicating said atomizing air supply passage either with said carburettor air inlet duct or with said air compressor as determined by said control device.

23. A constant pressure carburettor as claimed in claim 22, including a pressure equalising aperture between said atomizing air supply passage and said float chamber.

24. a constant-pressure carburettor as claimed in claim 21, wherein said control device comprises means defining first and second diaphragm chambers and including a diaphragm separating said first and second chambers, said first diaphragm chamber having an inlet connected to the outlet of said air compressor, a spring loaded valve biassed towards closing said inlet, and an outlet from said first chamber, said second diaphragm chamber having a control inlet connected to said carburettor suction duct, a compression spring acting on said diaphragm so as to urge said diaphragm towards a position wherein said diaphragm engages and opens said inlet valve of said first chamber, and means for controlling operation of said air compressor in accordance with the position of said diaphragm.

25. A constant-pressure carburettor as claimed in claim 24, wherein said compressor control means comprises an electric switch for making or breaking a current supply to said air compressor.

26. A constant-pressure carburettor as claimed in claim 24, including means effecting a throttled communication between said first diaphragm chamber and said mixing chamber of said carburettor.

27. A constant-pressure carburettor as claimed in claim 24, wherein said control device functions as a combination of a pressure switch and a pressure regulator, and is operative to switch on said air compressor before opening said inlet valve to said first diaphragm chamber when said spring in said second chamber is moving said diaphragm towards said valve.

28. A constant-pressure carburettor as claimed in claim 24, wherein said means for communicating said control chamber of said air intake valve controller either with said carburettor air inlet duct or with said air compressor comprises a non-return valve having first, second and third ports, means connecting said carburettor air inlet duct to said first port, means connecting the outlet from said first diaphragm chamber of said control device to said second port, means connecting said control chamber to said third port, and a shut-off member in said non-return valve adapted to close said first port when said inlet valve of said first diaphragm chamber of said control device is open and said air compressor is operating.

29. A constant-pressure carburettor as claimed in claim 28, wherein said shut-off member is adapted to close said second port when said inlet valve of said first diaphragm chamber is closed.

30. A constant-pressure carburettor as claimed in claim 28, including means connecting said atomizing air supply passage to said third port of said non-return valve.

* * * * *